US006658220B2

(12) United States Patent
Bessho et al.

(10) Patent No.: US 6,658,220 B2
(45) Date of Patent: Dec. 2, 2003

(54) IMAGE FORMING APPARATUS INCLUDING CONTACT TRANSFER MEMBER HAVING TRANSFER CURRENT CONTROLLED IN ACCORDANCE WITH RATIO OF IMAGE PORTION AT TRANSFER PORTION

(75) Inventors: Yuji Bessho, Chiba (JP); Hiroki Takayanagi, Chiba (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/265,418

(22) Filed: Oct. 7, 2002

(65) Prior Publication Data

US 2003/0072579 A1 Apr. 17, 2003

(30) Foreign Application Priority Data

Oct. 11, 2001 (JP) ..... 2001-314475

(51) Int. Cl.[7] ..... G03G 15/16
(52) U.S. Cl. ..... 399/44; 399/66
(58) Field of Search ..... 399/40, 44, 45, 399/66, 231, 299

(56) References Cited

U.S. PATENT DOCUMENTS 5,633,703 A * 5/1997 Takenouchi et al. ..... 399/44
2002/0051655 A1 * 5/2002 Maruta et al. ..... 399/227

FOREIGN PATENT DOCUMENTS

JP 03065975 A * 3/1991 ..... G03G/15/16
JP 8-83006 3/1996
JP 10-78691 3/1998

OTHER PUBLICATIONS

English translation of Jinzai (JP10–078691).*

* cited by examiner

*Primary Examiner*—Sophia S. Chen
*Assistant Examiner*—Ryan Gleitz
(74) *Attorney, Agent, or Firm*—Fitzpatrick, Cella, Harper & Scinto

(57) ABSTRACT

An image forming apparatus includes an image bearing member, an image forming portion for forming an image on the image bearing member, a contact transferring member for transferring the image formed on the image bearing member onto a transferring medium, a transferring current applying portion for applying a current to the contact transferring member, and a controller for controlling an amount of the current applied by the transferring current applying portion. Images formed on the image bearing member are transferred in a superposed manner onto the transferring medium, which is being conveyed. The controller determines an amount of current to be applied to the contact transferring member based on: the image ratio in the direction perpendicular to the direction in which the transferring medium is conveyed, of an image that has already been transferred on the transferring medium; the image ratio in the direction perpendicular to the direction in which the transferring medium is conveyed, of an image on the image bearing member; and the image ratio in the direction perpendicular to the direction in which the transferring medium is conveyed, of a portion in which the images overlap.

7 Claims, 12 Drawing Sheets

IMAGE FORMING APPARATUS INCLUDING CONTACT TRANSFER MEMBER HAVING TRANSFER CURRENT CONTROLLED IN ACCORDANCE WITH RATIO OF IMAGE PORTION AT TRANSFER PORTION

BACKGROUND OF THE INVENTION

1. Field of the Invention

The present invention relates to an image forming apparatus, such as a copying machine, a printer, a facsimile machine, and the like, that forms an image utilizing an electrophotography system.

2. Related Background Art

In FIG. 9, a structure of a so-called tandem type color image forming apparatus is schematically shown. The tandem type color image forming apparatus has a plurality of image forming portions that form toner images of different colors, respectively, where a color image is formed by sequentially superposing the individual color images on a transferring material. In the image forming portions Pa, Pb, Pc and Pd, toner images of respective colors, i.e., magenta, cyan, yellow and black, are formed in accordance with an electrophotography system.

In the respective image forming portions Pa, Pb, Pc and Pd, upon emission of a signal for starting an image forming operation, photosensitive drums 1*a*, 1*b*, 1*c* and 1*d*, which are driven to rotate at a specific process speed, are charged by charging rollers 2*a*, 2*b*, 2*c* and 2*d*, respectively. On the other hand, exposing apparatuses 6*a*, 6*b*, 6*c* and 6*d* convert input image signals that have been separated for respective colors into light signals. The photosensitive drums 1*a*, 1*b*, 1*c* and 1*d* that have been charged as above are exposed to laser beams modulated as light signals so as to be scanned, respectively, whereby electrostatic latent images are formed on the photosensitive drums 1*a*, 1*b*, 1*c* and 1*d*.

The electrostatic latent image formed on the photosensitive drum 1*a* is first visualized (developed) as a toner image by applying yellow toner onto the electrostatic latent image using a developing apparatus 3*a*.

In synchronization with this visualization (development), a transferring material P, such as a paper sheet, which is electrostatically absorbed to a surface of a transferring material conveying belt 9, and which is moved by a driving roller 10*a*, is conveyed to a transferring portion located between the photosensitive drum 1*a* and a transferring blade 4*a* of the image forming portion Pa, whereby the yellow toner image on the photosensitive drum 1*a* is transferred onto the transferring material P with the aid of the transferring blade 4*a*, to which a transferring bias is applied. The transferring material conveying belt 9 is looped around the driving roller 10*a* and a driven roller 10*b*.

Similarly, in the image forming portion Pb, a magenta toner image formed on the photosensitive drum 1*b* is transferred with the aid of a transferring blade 4*b*, to which a transferring bias is applied, onto the transferring material P in such a way that the magenta toner image is superposed on the yellow toner image on the transferring material P. Subsequently, cyan and black toner images formed on the photosensitive drums 1*c* and 1*d* are sequentially transferred with the aid of transferring blades 4*c* and 4*d*, to which a transferring bias is applied, onto the transferring material P in such a way that the cyan and black toner images are superposed on the yellow and magenta toner images that have been superposed on the transferring material P. Thus, a full color toner image is formed on the transferring material P.

The transferring material P, on which the full color toner image has been transferred, is conveyed to a fixing apparatus 13. The fixing apparatus 13 applies heat and pressure to the transferring material at a fixing nip between a fixing roller 13*a* and a pressurizing roller 13*b*, so that the full color toner image is fixed on the transferring material P. After the fixing operation, the transferring material P is discharged from the apparatus. In the above transferring process, residual toner remaining on the photosensitive drums 1*a*, 1*b*, 1*c* and 1*d* is removed and collected by cleaning apparatuses 5*a*, 5*b*, 5*c* and 5*d*.

Recently, a contact transferring member, such as a transferring blade or a transferring roller, has become widely used as transferring means of a contact transfer scheme, as is the case in the above-described example of the image forming apparatus. The contact transferring member is adopted in view of its advantageous stability in transferring images. A contact transfer system that uses a contact transferring member such as a transferring blade or a transferring roller has advantages in that a transferring voltage is reduced, as compared to a conventional corona transfer system, and the amount of ozone generated during the process is small.

As means for applying transferring bias to such a contact transferring member, a constant current system that applies a constant current is sometimes used, in order to cope with variations, such as resistance variations due to environmental variations, in the electrical resistance of the contact transferring member.

The constant current application system as described above suffers from the following problems.

In a portion of a photosensitive drum extending along the longitudinal direction of the drum that is located at a transferring portion at which a contact transferring member (i.e., transferring blade or transferring roller, etc.) abuts the photosensitive drum, a relatively large transferring current flows in a portion (or area) in which a toner image is absent; it is more difficult for current to flow in a portion in which a toner image is present due to the toner's resistance. Therefore, when an image in which an image ratio (or percentage of image) along the longitudinal direction of the photosensitive drum is high is to be formed, a high quality image that does not involve transferring errors would be obtained with a small transferring current; on the otherhand, when an image in which an image ratio along the longitudinal direction of the photosensitive drum is low is to be formed, a relatively large transferring current is required in order to obtain a high quality image.

In such an image forming apparatus, when the transferring current is set to a value optimum for images in which the image ratio along the longitudinal direction of the photosensitive drum is high, transferring errors would occur upon forming images in which the image ratio along the longitudinal direction of the photosensitive drum is low, due to a shortage of the transferring current. On the other hand, when the transferring current is set to a value optimum for images in which the image ratio along the longitudinal direction of the photosensitive drum is low, transferring errors such as inversion in the polarity of toner would occur upon forming images in which the image ratio along the longitudinal direction of the photosensitive drum is high due to an excessive current flow in the toner image.

In view of the above situations, a method has been conceived that controls the transferring current in accordance with the image ratio so as to avoid variations in transferring performance due to variations in the image ratio, as described in, for example Japanese Patent Application Laid-Open No. 08-083006.

However, in an image forming apparatus like the apparatus shown in FIG. 9, which forms a color image by superposing toner images of different colors, a preceding color toner image(s) already is present on the transferring material when a subsequent color image is transferred onto the transferring material, so transferring errors cannot be fully avoided by taking into account only the image ratio of a monochromatic (or single-color) toner images, like in the above-mentioned Japanese Patent Application Laid-Open No. 08-083006, and transferring errors can still occur.

In the following, the way in which such transferring errors occurs will be described, referring to FIGS. 10A and 10B.

As shown in FIG. 10A, in the image forming portion Pa a first color toner image (i.e., yellow toner image) denoted by t is formed on the photosensitive drum 1*a* at about the center with respect to the longitudinal direction of the drum 1*a*. Then, as shown in FIG. 10B, in the image forming portion Pb, a second color toner image (i.e., magenta toner image) t1 formed on the photosensitive drum 1*b* is transferred so as to be superposed on the first color toner image (or yellow toner image).

In doing so, according to the method disclosed in Japanese Patent Application Laid-Open No. 08-083006, a common or the same setting of the transferring current is used in both the transferring processes shown in FIGS. 10A and 10B. However, in the case shown in FIG. 10B, the value of a current that actually flows through the second color toner image t1 differs from that value in the case of FIG. 10A due to the presence of the first color toner image t in FIG. 10B.

As per the above, in the transferring current setting operation described in Japanese Patent Application Laid-Open No. 08-083006, the transferring current is appropriate only for the first color toner image t in FIG. 10A; it is too large for the second color toner image t1 in FIG. 10B, in which the first color toner image t is present as well as the second color toner image t1. This excessive current would cause transferring errors, such as inversion of toner polarity, etc.

On the other hand, an optimum value for the transferring current varies depending on the type of the transferring material, such as paper, or on variations in the electrical charge amount of the toner due to environmental variations of the image forming apparatus. Therefore, such methods as described in Japanese Patent Application Laid-Open No. 08-083006 that take into account only the image ratio of a monochromatic toner image suffer from a problem in that transferring errors due to variations in the electrical charge amount of the toner can occur.

Japanese Patent Application Laid-Open No. 10-78691 discloses another prior art system. When red and black toner images that have been multiple-transferred on a photosensitive drum are to be transferred onto a transferring material at the same time by a corona transferring charger, optimum transferring points for respective images that have different electrical charges of the toner are different from each other. This prior art focuses on avoiding transferring errors due to the difference in the optimum transferring points upon transferring the toner images at the same time. Japanese Patent Application Laid-Open No. 10-78691 teaches a method of determining an optimum transferring current based on the respective image ratios of red and black, and the ratio (or proportion) of the overlapping of the images. However, the prior art disclosed in Japanese Patent Application Laid-Open No. 10-78691 is not directed to a contact transfer scheme; it has nothing to do with the transferring error problem related to the flow of transferring current along the longitudinal direction of the photosensitive drum, to which the present invention is directed. Therefore, there is no description related to image ratios along the longitudinal direction of the drum in Japanese Patent Application Laid-Open No. 10-78691, and the prior art disclosed therein cannot effectively overcome the problem focused on by the present invention.

SUMMARY OF THE INVENTION

In view of the above situation, an object of the present invention is to provide an image forming apparatus that can apply an optimum transferring current even upon transferring different toner images in a superposed manner.

For the above purpose, according to the present invention there is provided as a preferred aspect thereof, an image forming apparatus comprising:

- an image bearing member;
- image forming means for forming an image on the image bearing member;
- a contact transferring member for transferring the image formed on the image bearing member onto a transferring medium;
- transferring current applying means for applying a current to the contact transferring member; and
- control means for controlling an amount of the current applied by the transferring current applying means;
- wherein images formed on the image bearing member are transferred in a superposed manner onto the transferring medium that is being conveyed, and
- wherein the control means determines an amount of current to be applied to the contact transferring member based on:
  - an image ratio in a direction perpendicular to a direction in which the transferring medium is conveyed, of an image that has already been transferred on the transferring medium,
  - an image ratio in a direction perpendicular to a direction in which the transferring medium is conveyed, of an image on the image bearing member, and
  - an image ratio in a direction perpendicular to a direction in which the transferring medium is conveyed, of a portion in which the images overlap.

Other object, features and advantages of the present invention will become more apparent upon consideration of the following description of the preferred embodiments of the present invention taken in conjunction with the accompanying drawings.

DETAILED DESCRIPTION OF THE EMBODIMENTS

Figure 1:
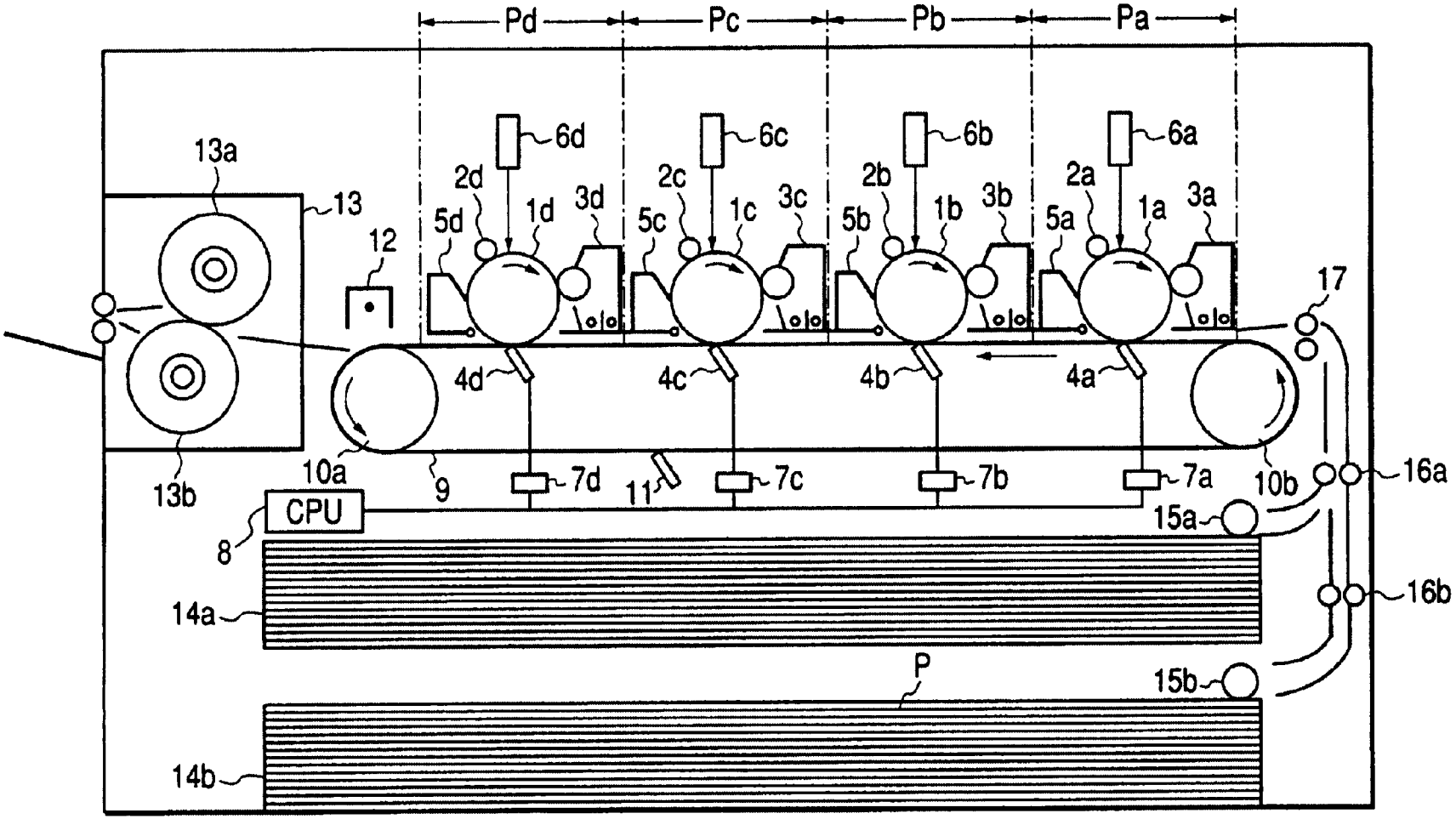
FIG. 1 is a drawing schematically showing a structure of an image forming apparatus according to a first embodiment of the present invention.

In the following, the present invention will be described with reference to the embodiments shown in the drawings.

Embodiment 1

Figure 9:
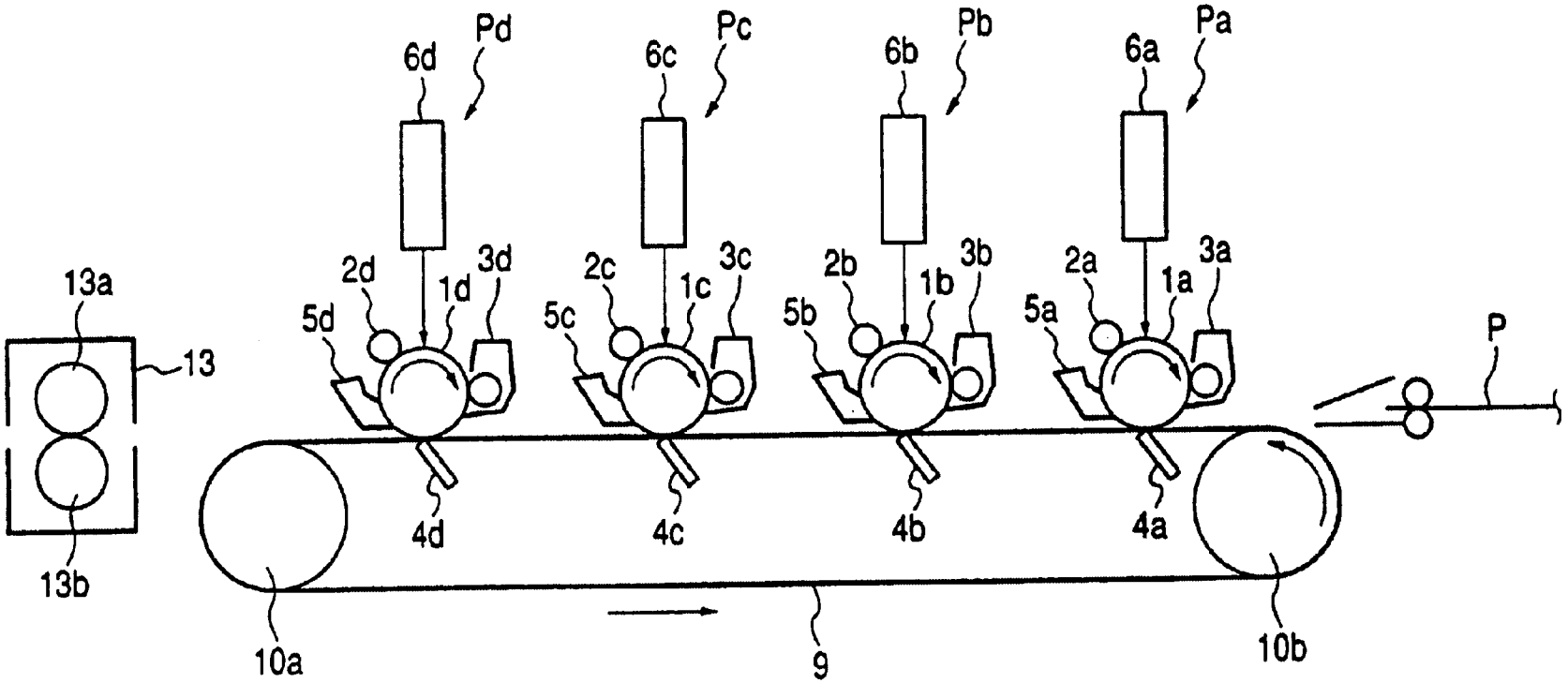
FIG. 9 PRIOR ART
FIG. 9 is a drawing schematically showing a structure of a conventional image forming apparatus.
Figure 10A:
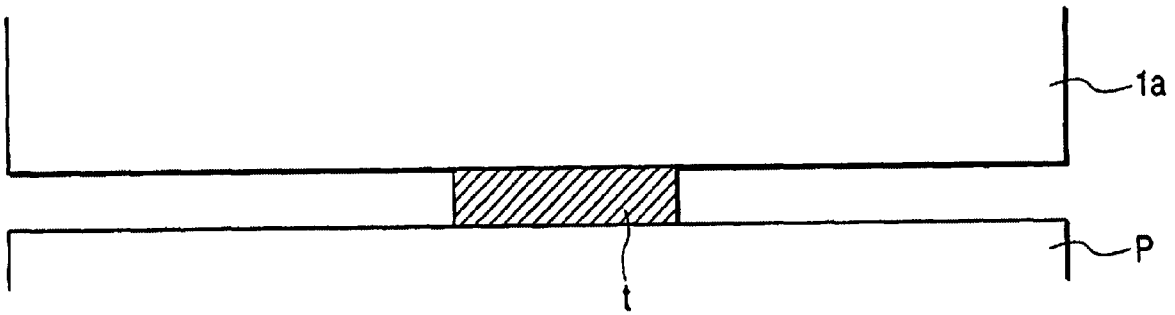
FIG. 10A is a drawing illustrating a transferred state of a first color toner image.
Figure 10B:
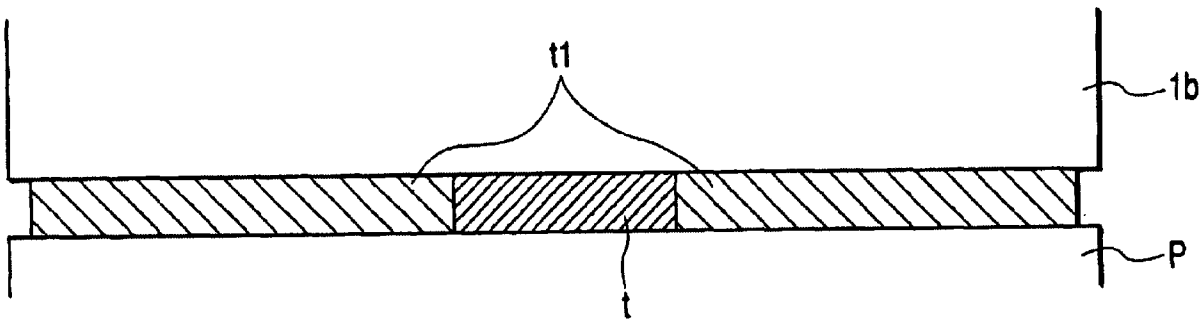
FIG. 10B is a drawing illustrating a transferred state in which a second color toner image is transferred over the first color toner image that has already been transferred.

FIG. 1 is a drawing schematically showing a structure of an image forming apparatus according to the first embodiment of the present invention. The image forming apparatus of this embodiment is a full color image forming apparatus such as a printer that utilizes an electrophotography system. In FIG. 1 and the following description, elements that have the same functions as the elements of the conventional image forming apparatus shown in FIG. 9 will be denoted by the same reference characters as in FIG. 9.

The image forming apparatus has four image forming portions (or image forming units), that is, an image forming portion Pa for forming a yellow image, an image forming portion Pb for forming a magenta image, an image forming portion Pc for forming a cyan image and an image forming portion Pd for forming a black image. These four image forming portions are aligned with each other with a certain space therebetween.

The image forming portions Pa, Pb, Pc and Pd are provided with photosensitive drums 1*a*, 1*b*, 1*c* and 1*d*, respectively, that serve as image bearing members. Around the photosensitive drums 1*a*, 1*b*, 1*c* and 1*d*, there are provided charging rollers 2*a*, 2*b*, 2*c* and 2*d*, developing apparatuses 3*a*, 3*b*, 3*c* and 3*d*, transferring blades 4*a*, 4*b*, 4*c* and 4*d* and drum cleaning apparatuses 5*a*, 5*b*, 5*c* and 5*d*. The image forming portions Pa, Pb, Pc and Pb are also provided with respective exposing apparatuses 6*a*, 6*b*, 6*c* and 6*d* disposed above a space between the charging rollers 2*a*, 2*b*, 2*c* and 2*d* and the developing apparatuses 3*a*, 3*b*, 3*c* and 3*d*.

In this embodiment, the photosensitive drums 1*a*, 1*b*, 1*c* and 1*d* are organic photosensitive drums, each of which comprises a drum body made of aluminum or the like on which a photosensitive layer is provided. The photosensitive drums 1*a*, 1*b*, 1*c* and 1*d* are driven by a driving apparatus (not shown) to rotate in the direction indicated by arrows (i.e. clockwise) at predetermined peripheral velocities (or processing speeds) respectively.

Each of the charging rollers 2*a*, 2*b*, 2*c* and 2*d* is in contact with the photosensitive drum 1*a*, 1*b*, 1*c* or 1*d* with a predetermined contact pressure so as to charge the surface of the photosensitive drum 1*a*, 1*b*, 1*c* or 1*d* uniformly to a predetermined negative potential by means of a charging bias applied by a high-voltage charging power source (not shown).

Each exposing apparatus 6*a*, 6*b*, 6*c* and 6*d* exposes the surface of a respective photosensitive drum 1*a*, 1*b*, 1*c* and 1*d* with a laser beam that has been modulated in accordance with a time-series electrical digital signal of image information input from a host computer (not shown), so that electrostatic latent images corresponding to the image information are formed on the respective photosensitive drums 1*a*, 1*b*, 1*c* and 1*d* that have been charged by the charging rollers 2*a*, 2*b*, 2*c* and 2*d*.

Each developing apparatus 3*a*, 3*b*, 3*c* and 3*d* makes the toner adhere to electrostatic latent images formed on the respective photosensitive drums by means of a developing bias applied by a high-voltage developing power source (not shown) to develop (in a reverse developing manner) the electrostatic latent images to produce toner images. The developing apparatuses 3*a*, 3*b*, 3*c* and 3*d* contain yellow toner, cyan toner, magenta toner and black toner, respectively.

Figure 2:
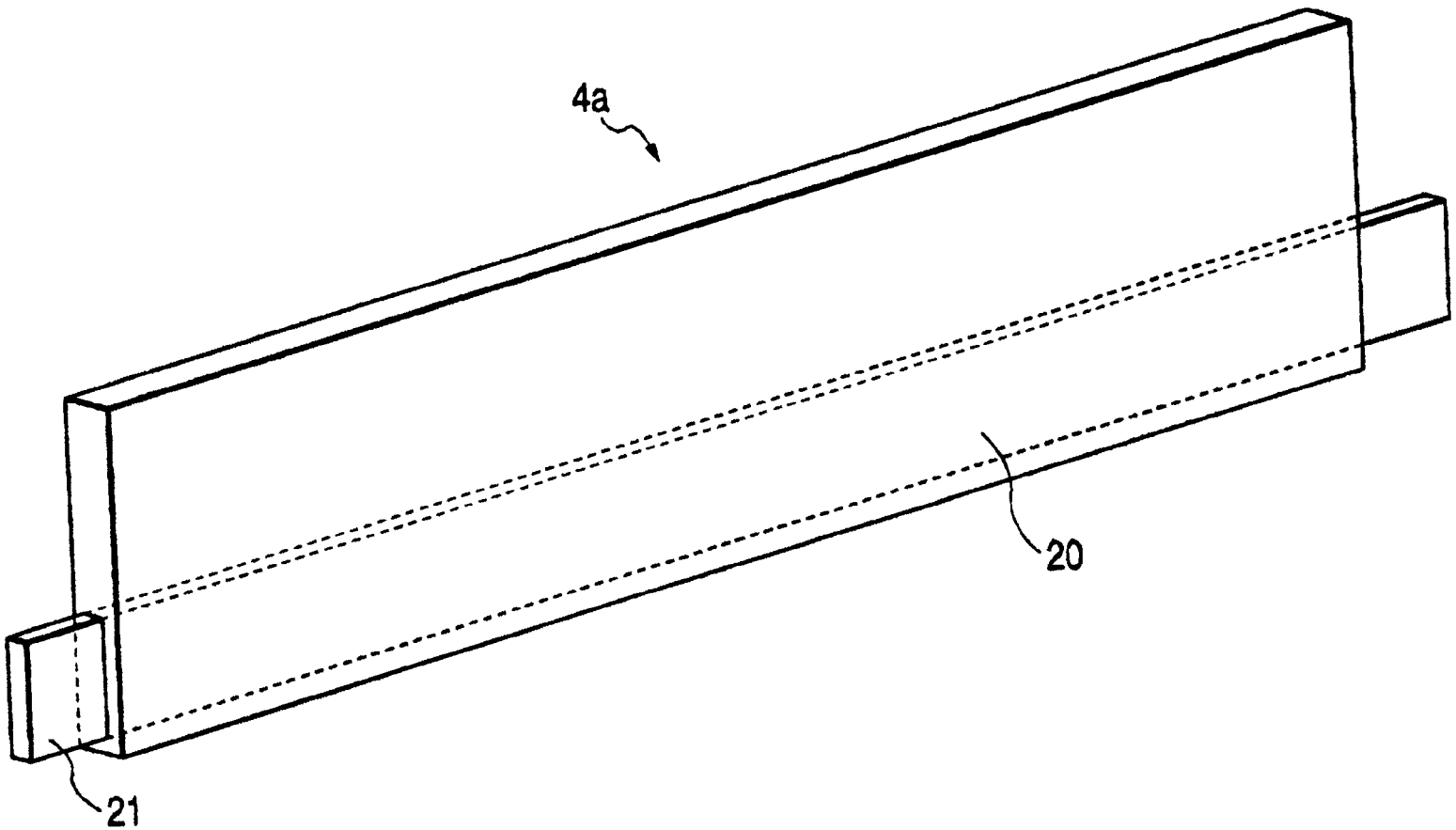
FIG. 2 is a perspective view showing a transferring blade.

Each of the transferring blades 4*a*, 4*b*, 4*c* and 4*d*, which functions as a contact transferring member, is comprised of a body 20 composed of rectangular plate made of an electrically conductive rubber and an electrically conductive electrode 21 extending along the lower end portion of the body 20 for applying voltage uniformly along the longitudinal direction of the body 20. While FIG. 2 shows the transferring blade 4*a* for the image forming portion Pa, the transferring blades 4*b*, 4*c* and 4*d* for the other image forming portions have the same structure.

The transferring blades 4*a*, 4*b*, 4*c* and 4*d* are disposed in such a way that the longitudinal direction of each body 20 coincides with a direction (which is a thrust direction) perpendicular to the direction in which transferring materials travel. The transferring blades 4*a*, 4*b*, 4*c* and 4*d* abut the respective photosensitive drums 1*a*, 1*b*, 1*c* and 1*d* at respective transferring nips with an endless transferring material conveying belt 9 therebetween.

The material of the body 20 of each transferring blade 4*a*, 4*b*, 4*c* and 4*d* may be a rubber material such as isoprene rubber, styrene rubber, butadiene rubber, nitrile rubber, ethylenepropylene rubber, butyl rubber, silicone rubber, chloropyrene rubber, chlorosulfonated polyethylene, acryl rubber, hydrin rubber, urethane rubber or fluorine rubber, synthetic rubber composed of some of these types of rubbers, or a synthetic resin, such as nylon, urethane or polyester, blended with an electrically conductive agent, such as tin oxide or carbon black. As the material for the body 20 of the blade, a material having a resistance of $10^3$ to $10^{10}$ Ω·cm and a degree of hardness of 5 to 80 (JISA) is generally used. Each of the bodies 20 of the transferring blades 4*a*, 4*b*, 4*c* and 4*d* used in this embodiment has a resistance of about $10^5$ to $10^7$ Ω·cm, a degree of thickness of 50 to 70 (JISA) and a thickness of about 2 mm.

The following facts are known in the art, that is: if a current that contributes to the transferring of an image is kept constant at an appropriate current, the resultant image can be stabilized (by a constant current control); and if a voltage that contributes to the transferring of an image is kept constant at an appropriate voltage, it is possible to reduce transferring errors that are likely to occur upon transferring an image to a transferring material of a small size or upon forming an image of a low image ratio (by a constant voltage control). In this embodiment, in order to cope with resistance variations of the transferring blades 4*a*, 4*b*, 4*c* and 4*b* due to environmental variations, the constant current system, in which a constant current is applied, is adopted, and the transferring current is set to about 20 μA.

The transferring blades 4*a*, 4*b*, 4*c* and 4*d* are connected with high-voltage transferring power sources 7*a*, 7*b*, 7*c* and 7*d*, respectively. The application of optimum transferring currents by the high-voltage transferring power sources 7*a*, 7*b*, 7*c* and 7*d* to the respective transferring blades 4*a*, 4*b*, 4*c* and 4*d* is controlled by a control apparatus 8, which will be specifically described later. The control apparatus 8 controls overall operations of the image forming apparatus including the rotation of the photosensitive drums 1*a*, 1*b*, 1*c* and 1*d*, application of the charging bias to the charging rollers 2*a*, 2*b*, 2*c* and 2*d*, application of the developing bias to the developing apparatuses 3*a*, 3*b*, 3*c* and 3*d* and exposing operations by the exposing apparatuses 6*a*, 6*b*, 6*c* and 6*d* in accordance with image information, etc.

The transferring material conveying belt 9 is looped around a driving roller 10*a* and a driven roller 10*b* and driven by the rotation of the driving roller so as to move (or rotate) in the direction indicated by an arrow. Downstream of the transferring material conveying belt 9 with respect to the transferring material conveying direction, there is provided a detach charger 12 for detaching or separating the transferring material P from the transferring material conveying belt 9 and a fixing apparatus 13 equipped with a fixing roller 13*a* and a pressurizing roller 13*b*.

In the following, a description will be made of an image forming operation in the above-described image forming apparatus according to the present embodiment.

Upon emission of a signal for starting the image forming operation, the photosensitive drums 1*a*, 1*b*, 1*c* and 1*d* of the respective image forming portions Pa, Pb, Pc and Pd, each of which is rotated at a predetermined process speed, are charged uniformly by the charging rollers 2*a*, 2*b*, 2*c* and 2*d*. In this embodiment, the polarity of the charge of the photosensitive drums is negative. The exposing apparatuses 6*a*, 6*b*, 6*c* and 6*d* convert image signals, which have been separated for respective colors, input from a host computer (not shown) into respective light signals, and expose the photosensitive drums 1*a*, 1*b*, 1*c* and 1*d* (that have been charged as described above) to laser beams, that is the light signals are thus converted, in a scanning manner, so as to form electrostatic latent images.

Then, first, the developing apparatus 3*a* makes yellow toner adhere to the electrostatic latent image formed on the photosensitive drum 1*a* to visualize (developed) it as a toner image. In doing so, the developing apparatus is applied with a developing bias of the same polarity as the charge of the photosensitive drum 1*a* (i.e., negative).

On the other hand, transferring materials, such as paper sheets accommodated in a filled cassette 14*a* or 14*b*, are separated sheet-by-sheet by a sheet feeding roller 15*a* or 15*b*. A separated transferring material P is conveyed to a registration roller pair 17 by a pair of conveying rollers 16*a* or 16*b* and brought onto the transferring material conveying belt 9 by the registration roller pair 17 at a predetermined timing in synchronization with the forming of the yellow toner image described above.

The transferring material P is electrostatically adsorbed, by an adsorption roller pair (not shown) to which an adsorption bias is applied, to the transferring material conveying belt 9 that is driven by the driving roller 10*a*. Thus, the transferring material P is conveyed to the transferring nip of the image forming portion Pa, at which the yellow toner image is transferred onto the transferring material P with the aid of the transferring blade 4*a* to which a transferring bias (the polarity of which is opposite to that of the toner, i.e., positive) is applied by the high-voltage transferring power source 7*a*. During this process, the transferring blade 4*a* is being pressed against the photosensitive drum 1*a* at a predetermined pressure with the transferring material P and the transferring material conveying belt 9 therebetween.

The transferring material P on which the yellow toner image has been transferred is adsorbed to the transferring material conveying belt 9 and moved toward the image forming portion Pb. At the transferring nip of the image forming portion Pb, the magenta toner image formed on the photosensitive drum 1*b* is also transferred, in the same manner as the process described above, to be superposed over the yellow toner image on the transferring material P with the aid of the transferring blade 4*b* to which a transferring bias (the polarity of which is opposite to that of the toner, i.e., positive) is applied by the high-voltage transferring power source 7*b*.

Subsequently, the cyan and black toner images formed on the photosensitive drums 1*c* and 1*d* are also transferred at the respective transferring nips in the same manner as above, so as to be sequentially superposed over the yellow and magenta toner images that have been transferred and superposed on the transferring material P, with the aid of the transferring blades 4*c* and 4*d* to which a transferring bias (the polarity of which is opposite to that of the toner, i.e., positive) is applied by the high-voltage transferring power sources 7*c* and 7*d*, respectively. Thus, a full color toner image is formed on the transferring material P.

Then, the transferring material P on which the full color toner image has been formed is detached from the transferring material conveying belt 9 with the aid of the detach charger 12 and conveyed to the fixing apparatus 13. The fixing apparatus 13 applies heat and pressure to the full color toner image on the transferring material P at a fixing nip between the fixing roller 13*a* and the pressurizing roller 13*b* so as to fix the full color toner image on the surface of the transferring material P by heat, and then discharges the transferring material P from the apparatus. Thus, a series of image forming operations are completed.

In the above-described transferring operations, residual toner remaining on the photosensitive drums 1*a*, 1*b*, 1*c* and 1*d* after the transferring operations, is removed and collected by the drum cleaning apparatuses 5*a*, 5*b*, 5*c* and 5*d*. Residual toner (such as a toner image used for density detection) remaining on the transferring material conveying belt 9 after the transferring operation is removed by a cleaning blade 11 so as to be collected.

In the following, how an optimum transferring current is set will be described with reference to FIGS. 3 and 4. This is a characterizing feature of the present invention.

In the image forming apparatus according to the embodiment described above, the optimum transferring current varies depending on the image ratio along the longitudinal direction (or thrust direction) of the photosensitive drum, of a toner image to be subjected to a transferring operation and the image ratio in the thrust direction of a toner image that has already been transferred on the transferring material P just before the transferring operation. The relationship between the image ratio and the optimum transferring current is, for example, like curves A and B shown in FIG. 3. Incidentally, FIG. 3 shows a case in which the width of the transferring material is substantially the same as the maximum width over which an image can be formed. Here, the term "image ratio" means the ratio or percentage of the area which the image or figure makes up (in other words, the area over which the image or figure is present) along the direction perpendicular to the direction in which the transferring material is conveyed.

Figure 3:
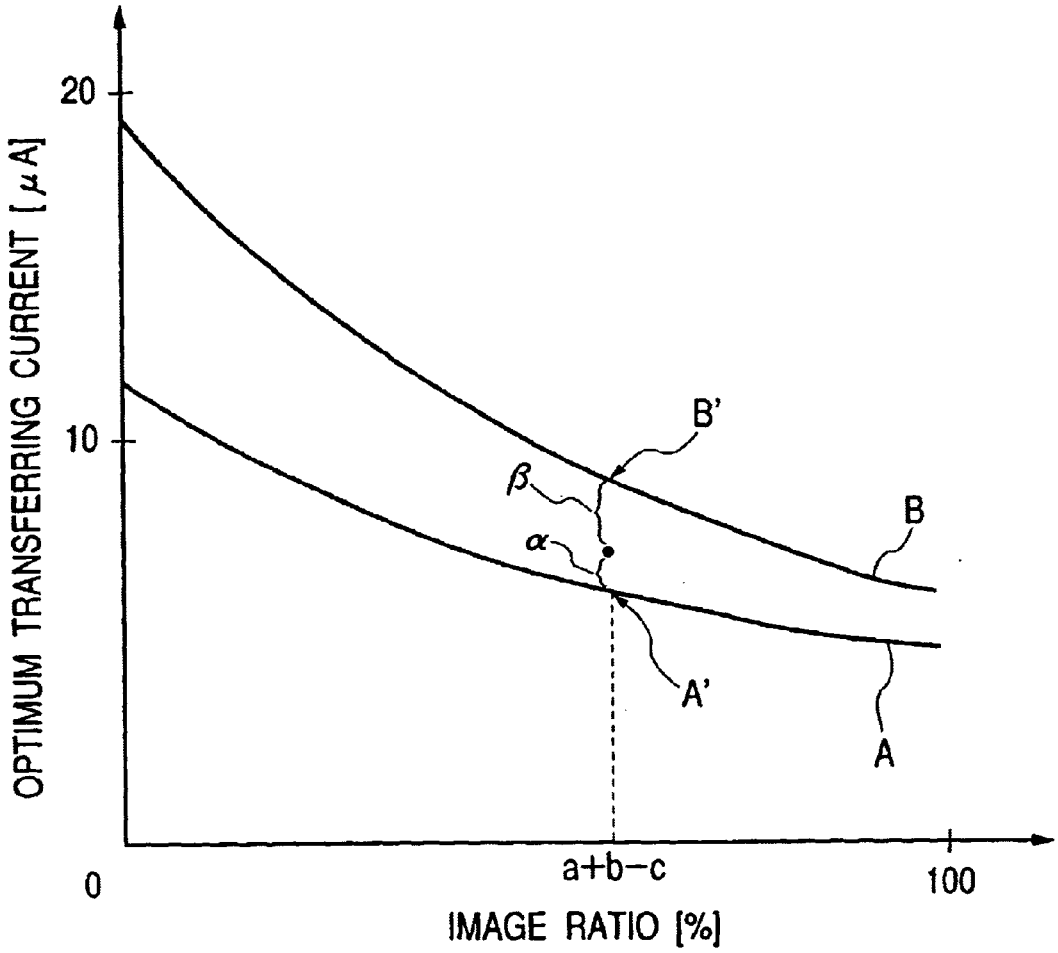
FIG. 3 is a graph showing a relationship between image ratio and optimum transferring current in the first embodiment of the present invention.
Figure 4:
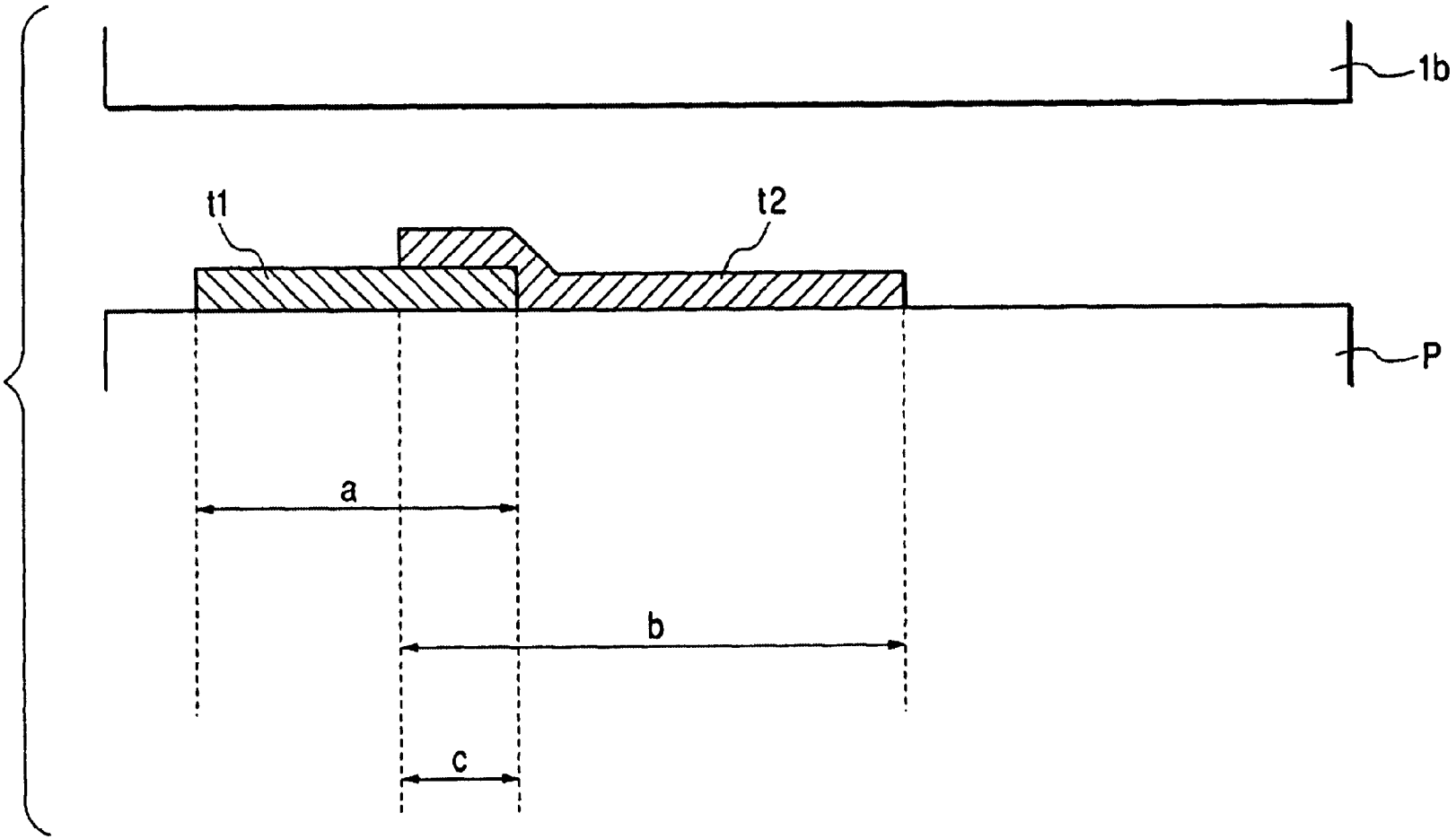
FIG. 4 is a drawing illustrating image ratios.

The curve A in FIG. 3 shows a relationship between the image ratio and the optimum transferring current in the case of a single-color (or monochrome) state, while the curve B shows a relationship between the image ratio and the optimum transferring current for a toner amount corresponding to two colors, namely, in the case in which two color toners overlap completely. As compared with the case of a single-color state, in the case in which an amount of toner corresponding to two colors is transferred, the resistance of the toner itself increases with the amount of the toner and the transferring current tends to flow into an area in which the image or figure is absent. Therefore, qualitatively speaking, the optimum transferring current is larger in the curve A than in the curve B.

In the following, the case of a transferring operation in the image forming portion Pb shown in FIG. 1 will be considered. As will be seen from FIG. 4, at the time of transferring a toner image from the photosensitive drum 1*b* in the image forming portion Pb onto the transferring material P, the transferring current is determined based on the superposition of the image ratio of a toner image t1 which has already been transferred on the transferring material P by the image forming portion Pa and a toner image t2 which is to be transferred by the image forming portion Pb. In FIG. 4, the image ratio of the toner image t1 transferred by the image forming portion Pa is a(%) and the image ratio of the toner image t2 transferred by the image forming portion Pb is b(%), and the image ratio of the portion of the toner image in which the toner image by the image forming portion Pa and the toner image by the image forming portion Pb overlap is c(%).

First, an optimum transferring current A' under a single-color (i.e., yellow) state in the image forming portion Pa and an optimum transferring current B' under a two-color (i.e., yellow and magenta) state in the image forming portion Pb are determined using the curves A and B in the graph shown in FIG. 3, based on the value (a+b−c) obtained by subtracting the image ratio of the overlapping portion from the sum of the image ratios in the image forming portion Pa and image forming portion PB. Next, in order to take into account properties of the overlapping portion of the two colors (yellow and magenta) in the image forming portion Pb, the ratio ($\alpha/(\alpha+\beta)$) of the single color (yellow) portion and the overlapping (yellow and magenta) portion in the toner image is obtained, and an optimum transferring current I is determined by the following equation (1) using that ratio:

$$I(\mu A)=A'+(B'-A')\times(\alpha/(\alpha+\beta)) \quad (1)$$

Where $\alpha=c/(a+b-c)$ and $\beta=(a+b-2c)/(a+b-c)$, namely $\alpha$ represents the proportion (or ratio) of the overlapping portion while $\beta$ represents the proportion of the non-overlapping portion.

In connection with this, in an image forming apparatus in the form of a laser printer or the like, image information is digitized or binarized, and so the image ratio can be obtained from bit map data in the control apparatus 8 that controls the exposing apparatuses (or writing apparatuses) 6*a*, 6*b*, 6*c* and 6*d*. Specifically, the image ratio along the longitudinal direction is calculated for each of the colors at a certain sampling interval (time) and such a control signal with which the optimum current I would be obtained is generated by the control apparatus based on the above equation (1), so that the high-voltage transferring power source 7*b* is controlled by the control signal, thereby applying the optimum transferring current to the transferring blade 4*b*. In the above process, the smaller the sampling interval is, the more finely the transferring current can be controlled, namely, under the more optimum condition the image forming can be performed. The control apparatus 8 controls the transferring operation while varying, at every sampling time, the transferring current that is optimized for the respective sampling times. In other words, the image forming apparatus is adapted to be capable of varying the transferring current during the transferring operation at every sampling time.

While the foregoing description has been directed to the case of the second upstream image forming portion Pb among the four image forming portions Pa, Pb, Pc and Pd, an optimum transferring current in the third or fourth upstream image forming portion Pc or Pd can be also determined based on a similar concept as above.

In the following, with reference to FIGS. 11 and 12, a description will be made of a method for determining an optimum transferring current upon transferring a toner image t3 from the photosensitive drum 1*c* in the third image forming portion Pc over toner images t1 and t2 that have already been transferred on the transferring material P based on the state of the superposition of the image ratios of the respective toner images.

Figure 11:
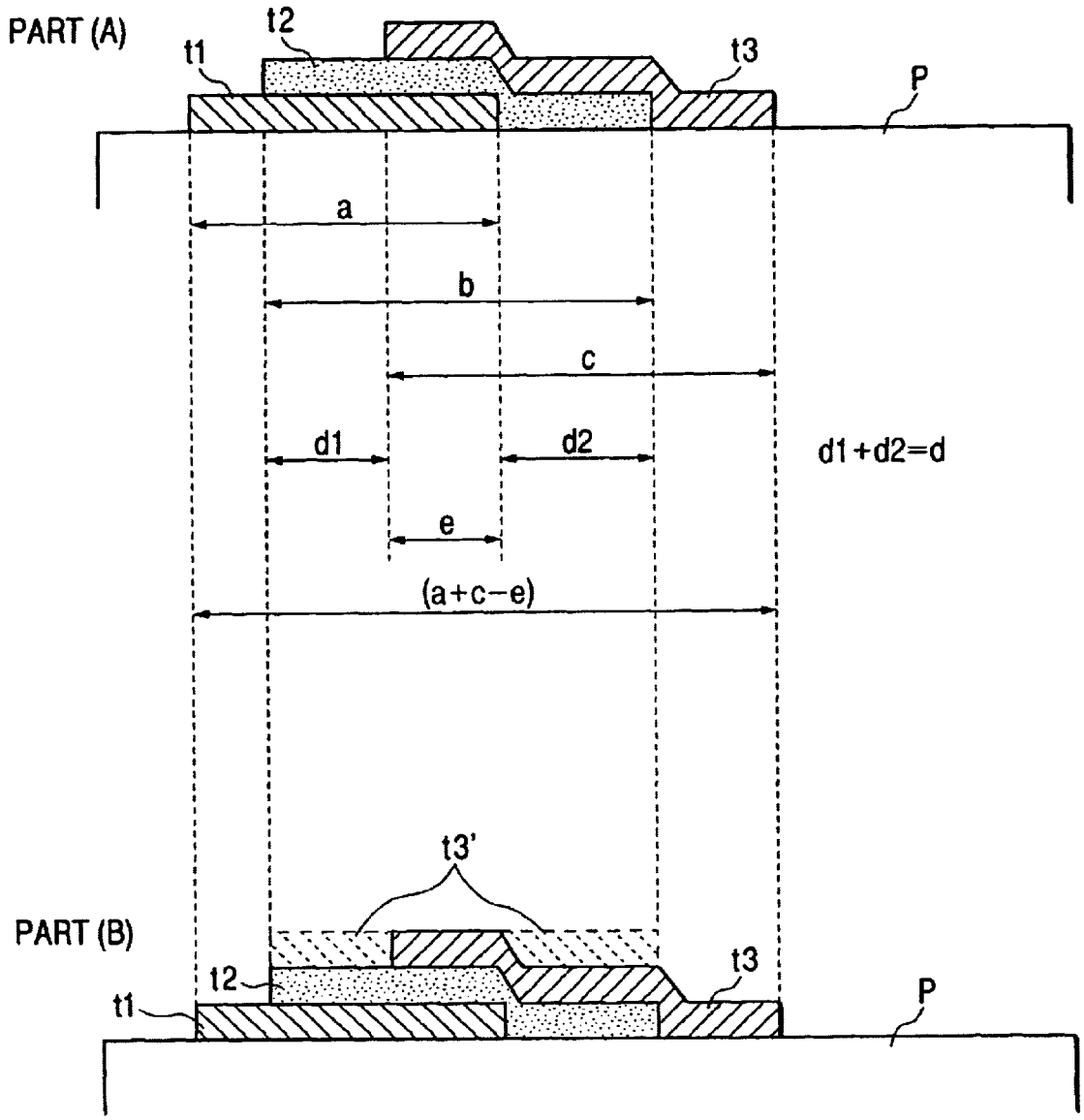
FIG. 11 is a drawing illustrating image ratios in a case in which toner images are transferred in three layers.

Part (A) of FIG. 11 shows a superposed state of three toner images, in which the image ratio along the longitudinal direction of the toner image t1 transferred by the image forming portion Pa is a(%), the image ratio along the longitudinal direction of the toner image t2 transferred by the image forming portion Pb is b(%), the image ratio along the longitudinal direction of the toner image t3 transferred by the image forming portion Pc is c(%), the proportion of the portion in which only two layers of the toner images overlap is d=d1+d2(%), and the proportion of the portion in which the three layers overlap is e(%).

Figure 12:
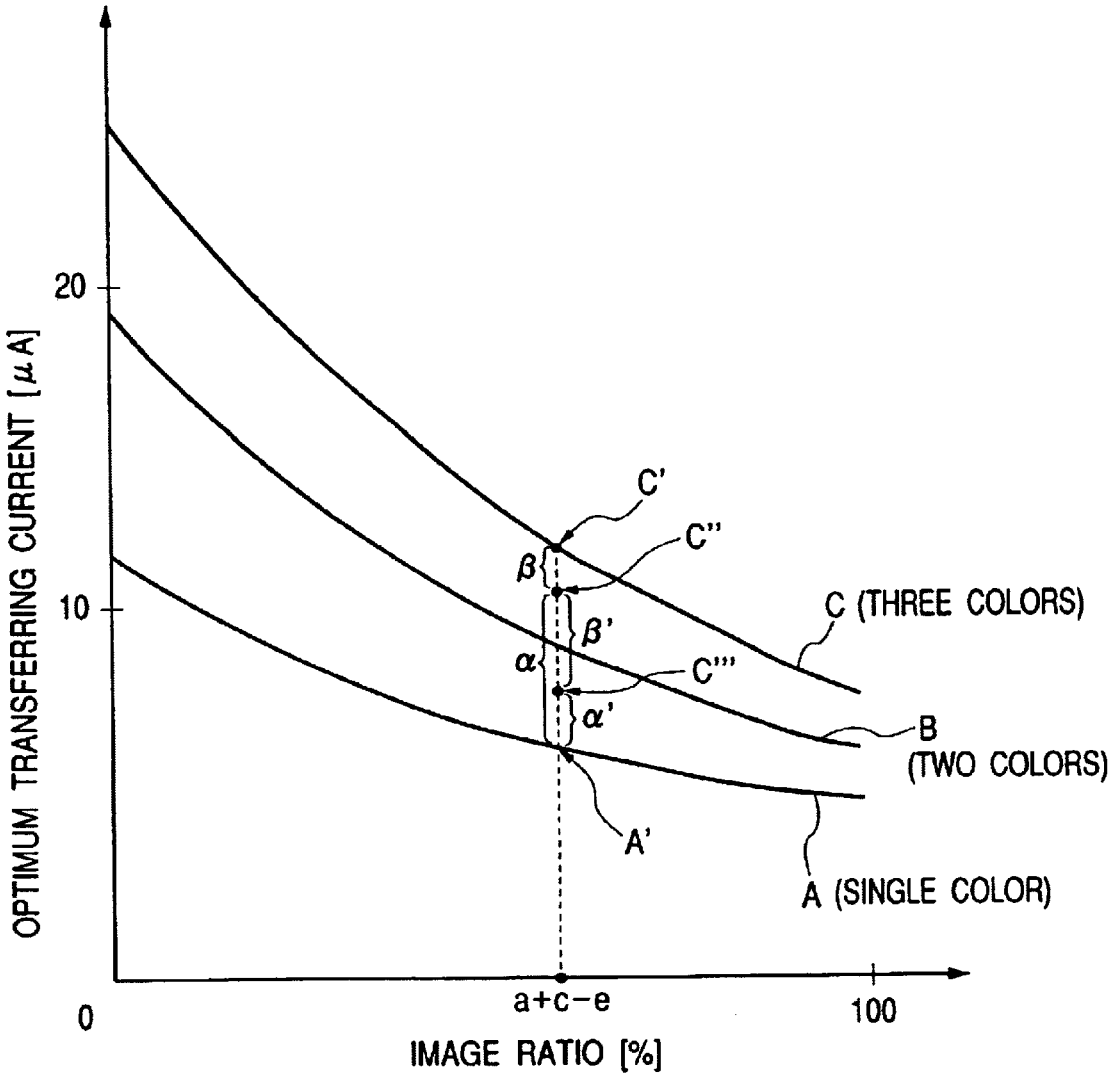
FIG. 12 is a graph showing a relationship between image ratio and optimum transferring current in a case in which toner images are transferred in three layers.

FIG. 12 shows a relationship between the image ratio in the longitudinal direction and the optimum transferring current for the cases of A: single color state, B: two colors overlapping completely, and C: three colors overlapping completely.

First, an optimum transferring current value is determined for a model shown in Part (B) of FIG. 11 in which the image ratio of the third layer is assumed to be the same as the image ratio b of the second layer (i.e., a model in which a third layer t3' shown in Part B of FIG. 11 is present). A method for determining the optimum transferring current for this model is similar to the method described in connection with FIGS. 3 and 4.

From FIG. 12, it can be found that a value of the optimum transferring current for a single-color (or monochrome) state with an image ratio (a+c−e) is A' and a value of the optimum transferring current for a completely overlapping three-color state with an image ratio (a+c−e) is C'. An optimum transferring current value C" for a state in which the image ratios of both of the second and third layers are b would fall between A' and C'. That optimum value is determined based on the proportion $\alpha$ of the portion in which three colors are overlapping and the proportion $\beta$ of the single-color portion, where $\alpha$, $\beta$ and C" are determined by the following equations:

$$\alpha=(d+e)/(a+c-e)$$

$$\beta=(a+c-d-2e)/(a+c-e)$$

$$C''=A'+(C'-A')\times(\alpha/(\alpha+\beta)).$$

Then, an optimum transferring current value C'" for the state shown in Part (A) of FIG. 11 is to be determined. Since the state shown in Part (A) of FIG. 11 is a state obtained by removing the portion t3' from the state shown in Part (B) of FIG. 11(B), the optimum transferring current C''' is obtained by considering the relationship between a toner image having the image ratio of t2 and a toner image having the image ratio of t3. Namely, the optimum transferring current C''', which falls between the optimum transferring current values C'' and A' obtained as above, is determined based on the proportion α' of the overlapping portion and the proportion β' of the second layer portion on which the third layer does not overlap, where α', β' and C''' are determined by the following equations:

$$\alpha'=e/b$$

$$\beta'=(b-e)/b$$

$$C'''=A'+(C''-A')\times(\alpha'/(\alpha'+\beta')).$$

As per the above, in this embodiment, for example in the image forming portion Pb, the ratio of the first color (i.e., yellow) toner image that has already been transferred onto the transferring material P and the portion in which the first color toner image and the second color (i.e., magenta) toner image overlap is obtained, and an optimum value I of the transferring current is determined using equation (1). Then, the optimum transferring current I thus determined is applied by the high-voltage transferring power source 7*b* to the transferring blade 4*b*. Thus, the optimum transferring current I can be applied in accordance with the respective image ratios of the first color (yellow) toner image and the second color (magenta) toner image, and so it is possible to prevent transferring errors from occurring, thereby to obtain high quality images.

Embodiment 2

The structure of an image forming apparatus according to the second embodiment is the same as that of the image forming apparatus according to the first embodiment shown in FIG. 1. So the description of the structure and the image forming operation of the image forming apparatus according to this embodiment will be omitted.

The apparatus according to this embodiment is constructed so that an optimum transferring current suitable for the image ratio of a toner image can be determined in accordance with various conditions, such as the type of the transferring material or the moisture condition of the transferring material.

Physical properties, such as thickness or volume resistivity, etc., of a transferring material vary depending on its type. Even in the same transferring material, the volume resistivity can vary in the range of about $10^6$ to $10^{15}$ Ωcm depending on its moisture condition. Therefore, in the image forming apparatus shown in FIG. 1, the optimum transferring current corresponding to the image ratio along the thrust direction of a toner image under a transferring operation and the image ratio along the thrust direction of a toner image that has already been transferred onto the transferring member just before the transferring operation varies depending on, for example, variations in the volume resistivity of a paper sheet used as the transferring material.

Figure 5:
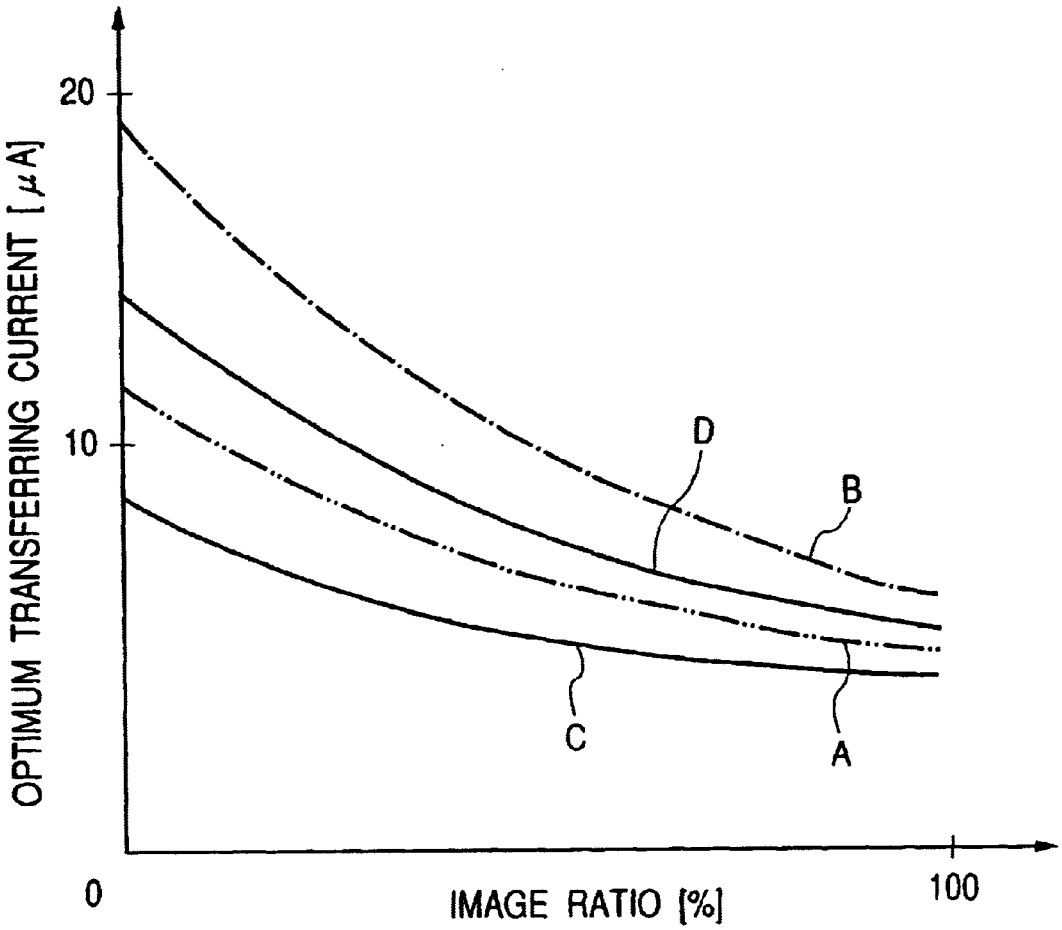
FIG. 5 is a graph showing a relationship between image ratio and optimum transferring current in the second embodiment of the present invention.

The relationship between the image ratio and the optimum transferring current is like curves C and D shown in FIG. 5. In FIG. 5, the curve C shows a relationship between the image ratio and the optimum transferring current in the case of a single-color (or monochrome) state, while the curve D shows a relationship between the image ratio and the optimum transferring current for a toner amount corresponding to two colors, namely, in the case in which two color toners overlap completely.

In FIG. 5, while the curves A and B are the relationships between the image ratio and the optimum transferring current in the first embodiment shown in FIG. 3, the curves C and D are relationships between the image ratio and the optimum transferring current with respect to a transferring material that has a higher volume resistivity than the transferring material used in the first embodiment shown in FIG. 3. An increase in the volume resistivity of the transferring material results in an increase in the electric resistance against the flow of the transferring current in the longitudinal direction of the photosensitive drum at the transferring nip in both the portion in which an image is present and the portion in which an image is absent, so that the current that flows into the portion in which an image is absent is reduced. Therefore, the optimum transferring current is relatively low in curves C and D as compared with the curves A and B shown in FIG. 3, as will be seen from FIG. 5.

Similarly, the thickness of the transferring material or other factors can also vary the electric resistance against the flow of the transferring current, which greatly affects the optimum transferring current corresponding to the image ratios. Therefore, in this embodiment, the apparatus is constructed in such a way that an optimum transferring current can be determined in accordance with the electric resistance in the transferring current direction of the transferring material.

The electrical resistance of the transferring material may be measured by equipment provided in the image forming apparatus, or alternatively, entered by a user directly through an operating unit. In the former case, the electrical resistance of a transferring material can be measured by nipping the transferring material between a pair of rollers and providing a flow of current between the rollers to monitor the voltage at that time. In this embodiment, data on the relationship between the image ratio and the optimum transferring current, such as the curves C and D shown in FIG. 5, associated with the electric resistance of the transferring material are stored in a memory (not shown) in the control apparatus 8 in advance, so that the relationship like the curves C and D of the image ratio and the optimum transferring current that corresponds to the electric resistance information of a transferring material to be used is read out from the memory to determine the optimum transferring current corresponding to the electric resistance of the transferring member.

Accordingly, in the image forming apparatus of this embodiment, for example in the image forming portion Pb, a control signal for producing an optimum transferring current value that have been determined in accordance with the electric resistance of the transferring material and the image ratios of the first color toner image and the second color toner image is generated by the control apparatus 8, and the high-voltage transferring power source 7*b* is controlled by that control signal so as to apply the optimum transferring current to the transferring blade 4*b*. The same process will also be performed in the image forming portion Pc or Pd.

As per the above, this embodiment is capable of determining an optimum transferring current in accordance with the electric resistance of the transferring member and the image ratios of the toner image to be transferred and the toner image(s) that has/have been already transferred. With this feature, it is possible to prevent transferring errors from occurring even if the electric resistance of the transferring member varies, and so high quality images can be obtained.

Embodiment 3

Figure 6:
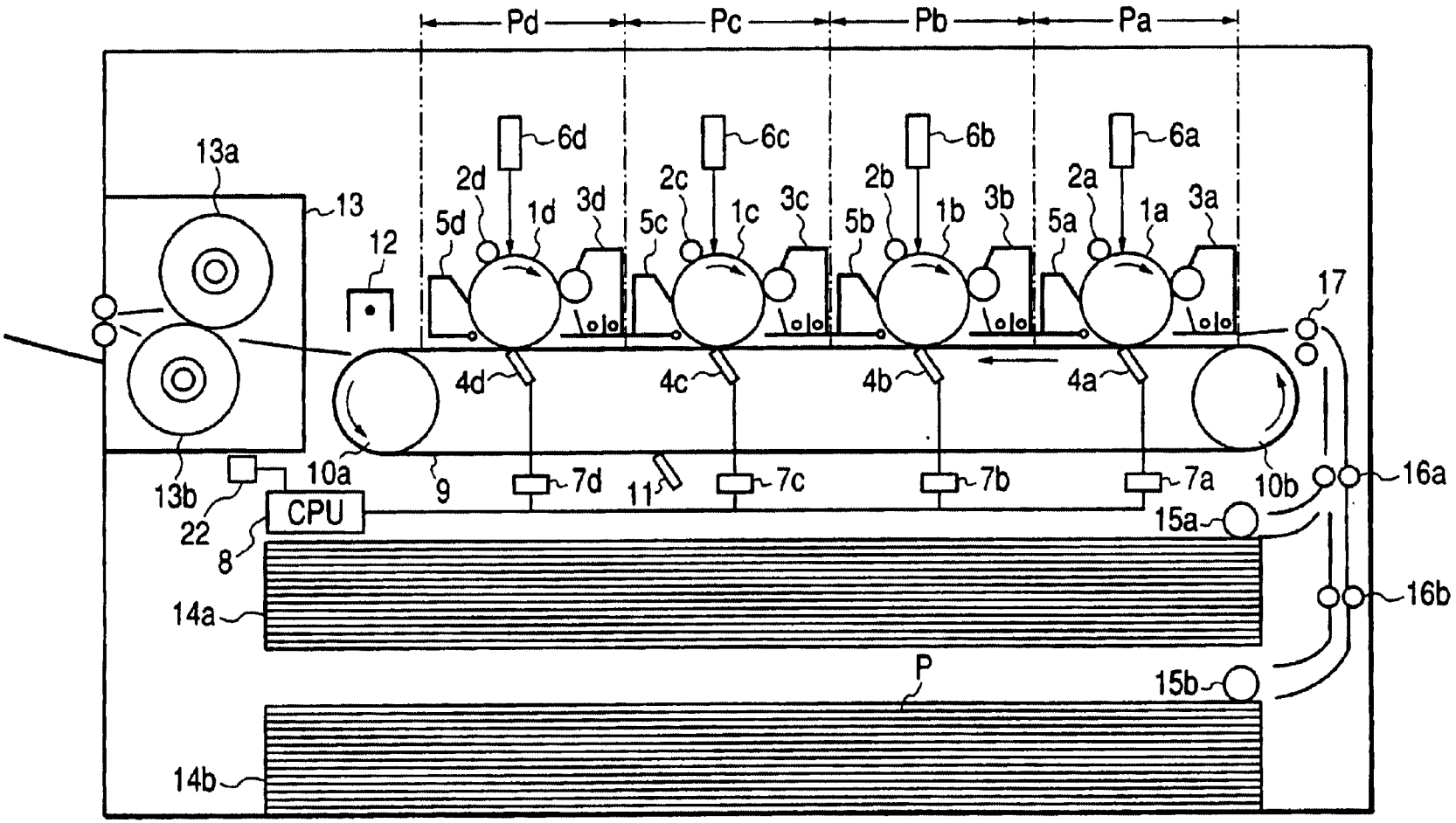
FIG. 6 is a drawing schematically showing a structure of an image forming apparatus according to a third embodiment of the present invention.

FIG. 6 is a drawing schematically showing a structure of an image forming apparatus according to the third embodiment of the invention. In this embodiment, the image forming apparatus has a temperature and humidity sensor 22 for detecting temperature and humidity conditions inside the image forming apparatus or in the environment thereof. The structures of apparatuses other than the temperature and humidity sensor 22 are the same as that of the image forming apparatus of the first embodiment shown in FIG. 1, so the description of the structure and the image forming operation of the image forming apparatus according to this embodiment will be omitted.

In this embodiment, an optimum transferring current corresponding to the image ratio of the toner image can be determined in accordance with temperature and humidity conditions inside the image forming apparatus or in the environment thereof.

The amount of charge per unit mass of toner (this charge amount will be referred to as "tribo" hereinafter) varies depending on the temperature and humidity conditions inside the image forming apparatus or in the environment thereof. Since the value of the optimum transferring current upon transferring varies with the tribo, the optimum transferring current corresponding to the image ratio also varies depending on the temperature and humidity conditions inside the image forming apparatus or in the environment thereof, like in the case of the second embodiment shown in FIG. 5.

In view of this fact, in this embodiment, the temperature and humidity inside the image forming apparatus is detected by the temperature and humidity sensor 22, and data on the relationship between the image ratio and the optimum transferring current, like the curves C and D shown in FIG. 5, associated with the detected temperature and humidity are stored in a memory (not shown) in the control apparatus 8 in advance, so that the relationship, like the curves C and D, of the image ratio and the optimum transferring current that corresponds to information on the temperature and humidity inside the image forming apparatus at the time of the transferring operation is read out from the memory to determine the optimum transferring current corresponding to the temperature and humidity inside the image forming apparatus at the time of the transferring operation.

Accordingly, in the image forming apparatus of this embodiment, for example in the image forming portion Pb, a control signal for producing an optimum transferring current value that has been determined in accordance with the temperature and humidity inside the image forming apparatus at the time of the transferring operation and the image ratios of the first color toner image and the second color toner image is generated by the control apparatus 8, and the high-voltage transferring power source 7*b* is controlled by that control signal to apply the optimum transferring current to the transferring blade 4*b*. The same process will also be performed in the image forming portion Pc or Pd.

As per the above, this embodiment is capable of determining an optimum transferring current in accordance with the temperature and humidity inside the image forming apparatus or in the environment thereof at the time of the transferring operation and the image ratios of the toner image to be transferred and the toner image that have been already transferred. With this feature, it is possible to prevent transferring errors from occurring even if the temperature and humidity inside the image forming apparatus or in the environment thereof varies, and so high quality images can be obtained.

In the embodiments described in the foregoing, the image forming apparatus is of a type in which toner images of different colors are transferred in a superposed manner onto a transferring material. But the present invention as described with reference to those embodiments can also be applied to a primary transfer process for transferring toner images onto an intermediate transferring member in the image forming apparatus in which toner images of different colors are primarily transferred in a superposed manner onto the intermediate transferring member and then secondarily transferred from the intermediate transferring member to a transferring material at one time.

Furthermore, in the embodiments described in the foregoing, the color image forming apparatus is provided with a plurality of photosensitive drums. But the present invention as described with reference to those embodiments can also be applied to a color image forming apparatus provided with a single photosensitive drum, such as an image forming apparatus in which toner images of different colors having been sequentially formed on a single photosensitive drum are transferred in a superposed manner onto a transferring drum in a transferring portion.

Embodiment 4

While the first embodiment of the invention shown in FIG. 1 shows an example in which the present invention is applied to an image forming apparatus in which toner images of respective colors formed on a plurality of photosensitive drums are transferred in a superposed manner onto a transferring material, in this fourth embodiment the invention is applied to an image forming apparatus in which toner images of respective colors formed on a single or plurality of photosensitive drum(s) are transferred in a superposed manner onto an intermediate transferring member at a primary transfer portion and then transferred onto a transferring material at one time at a secondary transfer portion.

Figure 7:
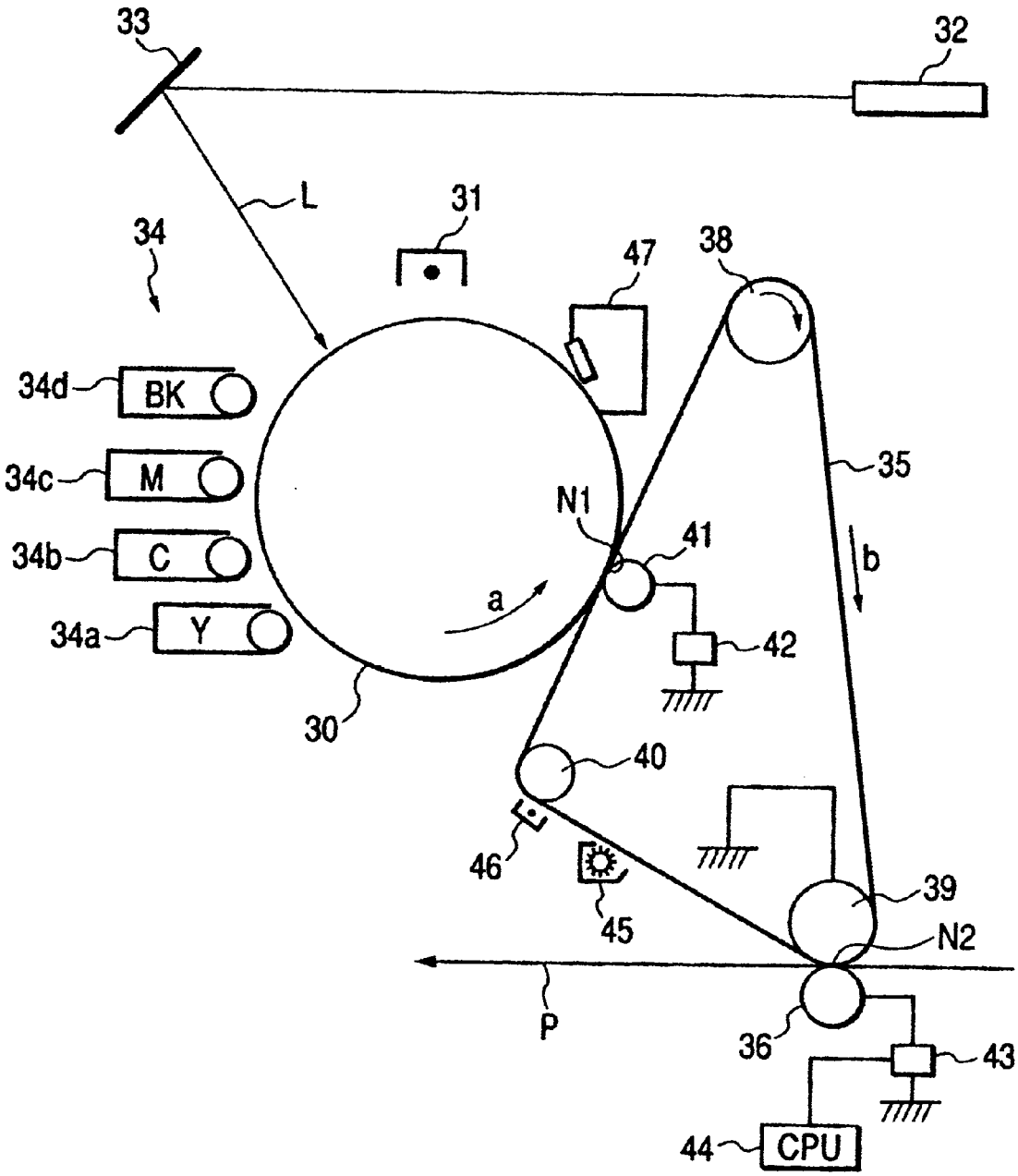
FIG. 7 is a drawing schematically showing a structure of an image forming apparatus according to a fourth embodiment of the present invention.

FIG. 7 is a drawing schematically showing an image forming apparatus, such as a laser printer capable of forming color images, that has an intermediate transferring member, according to the fourth embodiment of the invention.

This image forming apparatus is provided with a photosensitive drum 30 that is supported so as to be rotatable in the direction indicated by arrow a. Adjacent to the photosensitive drum 30, there is provided a developing apparatus 34 including four developing devices 34*a*, 34*b*, 34*c* and 34*d*, which contain four color toners, that is, yellow (Y) toner, magenta (M) toner, cyan (C) toner and black (BK) toner, respectively. The developing devices 34*a*, 34*b*, 34*c* and 34*d* are constructed so that any one of the developing apparatuses that is used for developing an electrostatic latent image on the photosensitive drum 30 is caused to abut the photosensitive drum 30 by attaching/detaching means.

The photosensitive drum 30 is in contact with an intermediate transferring belt 35, which functions as the intermediate transferring member, at a primary transfer portion N1, and with a transferring material p and a secondary transferring roller 36 at a secondary transfer portion N2.

Upon forming an image, the photosensitive drum 30 is charged by a charger uniformly and irradiated with scanning light (i.e., a laser beam) L emitted from an exposing apparatus (or laser exposure optical system) 32 and reflected by a mirror 33, so that electrostatic latent images corresponding to images of the respective color components are formed on the photosensitive drum 30. Then toners of the respective colors are applied to the electrostatic latent images corresponding to images of the respective color components by the developing devices 34*a*, 34*b*, 34*c* and 34*d*, respectively, so that the electrostatic latent images are developed to produce toner images. The toner images are then primarily transferred at the primary transfer portion N1 in a superposed manner onto the intermediate transferring belt 35 to form a color toner image.

The color toner image that has been primarily transferred onto the intermediate transferring belt 35 is transferred at the secondary transfer portion N2 onto a transferring material, such as a paper sheet, that is being nipped and conveyed between a secondary transferring roller 36 and the intermediate transferring belt 35.

The primary transfer and secondary transfer as mentioned above will be described below in detail.

When, for example, the photosensitive drum 30 is made of an OPC (organic photo conductor) photosensitive member of negative polarity, toners of negative polarity are used upon developing the exposed portions that have been exposed with the scanning light (i.e., laser beam) by means of the respective developing devices 34*a*, 34*b*, 34*c* and 34*d*. Accordingly, a primary transferring roller 41 that abuts the photosensitive drum 30 at the primary transfer portion N1 with the intermediate transferring belt 35 therebetween, is applied with a primary transferring bias of positive polarity by a high-voltage primary transferring power source 42.

The intermediate transferring belt 35 is composed of an endless belt of a resin film, such as PVDF (polyvinylidene fluoride), nylon, PET (polyethylene terephthalate) or polycarbonate, etc., having a thickness of 50 to 200 $\mu$m and a resistance of $10^8$ to $10^{16}$ $\Omega\cdot$cm (the resistance of the resin film being adjusted appropriately, if necessary). The intermediate transferring belt 35 is looped around a driving roller 38, a secondary transfer opposing roller 39 and a tension roller 40, and driven by the driving roller 38 so as to rotate (or move) in the direction indicated by arrow b.

As the primary transferring roller 41, a low resistance roller having a resistance of not more than $10^6$ $\Omega\cdot$cm is generally used. By using a thin film as the intermediate transferring belt 35, it is possible to ensure an electrostatic capacity as large as several hundreds to several thousands picofarad at the primary transfer portion N1, and so the transferring current can be stabilized.

The secondary transfer at the secondary transfer portion N2 is performed by applying a secondary transferring bias of positive polarity to the secondary transferring roller 36 by a high-voltage transferring power source 43 using the secondary transfer opposing roller 39 that is in contact with the inner side of the intermediate transferring belt 35 as an opposed electrode, while causing the second transferring roller 36 to be in contact with the backside surface of the transferring material P. This embodiment adopts a constant current system in which a constant current is applied as is the case with the preceding embodiments, in order to cope with resistance variations such as variations in the resistance of the secondary transferring roller 36 due to environmental variations.

As described above, the secondary transferring roller 36 is connected with the high-voltage secondary transferring power source 43, and an optimum secondary transferring current is applied to the secondary transferring roller 36 by the high-voltage secondary transfer power source 43 while controlled by a control apparatus (i.e., a CPU) 44 (this process will be specifically described later). The control apparatus 44 controls overall operations of the image forming apparatus including the image forming operation described above.

Residual toner remaining on the photosensitive drum 30 after the primary transfer is removed and collected by a drum cleaning apparatus 47 and residual charge remaining on the photosensitive drum 30 is cleared by an exposing device (not shown), so that the photosensitive drum 30 is subjected to the next image forming operation. On the other hand, residual toner and residual charge remaining on the intermediate transferring belt 35 are removed by a belt cleaning apparatus 45 and a static eliminating charger 46 respectively.

In the following, how an optimum secondary transferring current is set in the secondary transfer operation will be described with reference to FIG. 8. For the sake of simplicity, the following description will be made of an example in which two color toners (e.g., magenta and cyan) are used, though the apparatus of the present embodiment is actually adapted to transfer toner images of four colors onto the intermediate transferring belt so as to superpose the toner images. It should be noted that the basic concept is also applicable to the case in which four color toners are used in the same way. In the case of two color toners, the relationship between the image ratio and the optimum secondary transferring current is, for example, like curves E and F shown in FIG. 8.

Figure 8:
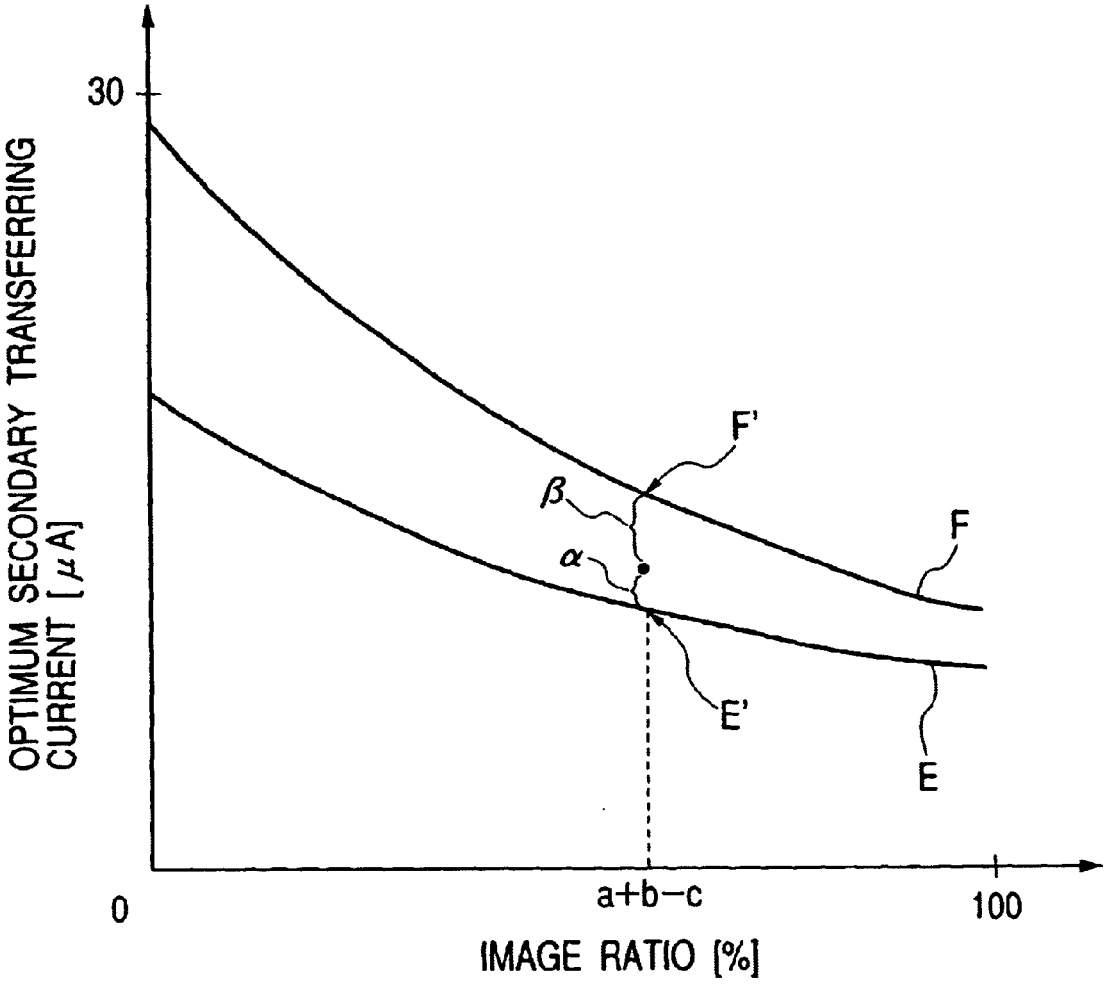
FIG. 8 is a graph showing a relationship between image ratio and optimum transferring current in the fourth embodiment of the present invention.

The curve E in FIG. 8 shows a relationship between the image ratio and the optimum secondary transferring current in the case of a single-color (or monochrome) state, while the curve F shows a relationship between the image ratio and the optimum secondary transferring current for a toner amount corresponding to two colors, namely, in the case in which two color toners overlap completely. As compared with the case of a single-color state, in the case in which an amount of toner corresponding to two colors is transferred, the resistance of the toner itself increases with the amount of the toner and the transferring current tends to flow into an area in which the image or figure is absent. Therefore, qualitatively speaking, the optimum secondary transferring current is larger in the curve F than in the curve E.

Here, it is assumed that the image ratio of the first color (e.g., magenta) toner image is a(%) and the image ratio of the second color (e.g., cyan) toner image is b(%), and the image ratio of the portion of the toner image in which the first color toner image and the second color toner image overlap is c(%). First, values of the optimum secondary transferring current E' and F' for the first and second color toners respectively are determined based on the value (a+b−c) obtained by subtracting the image ratio of the overlapping portion from the sum of the image ratios of the first and second color toner images. Next, in order to take into account properties of the overlapping portion of the first and second color toners, the ratio ($\alpha/(\alpha+\beta)$) of the single color (magenta) portion and the overlapping (magenta and cyan) portion in the toner image is obtained, and an optimum secondary transferring current I is obtained by the following equation (2) using that ratio:

$$I(\mu A)=E'+(F'-E')\times(\alpha/(\alpha+\beta)) \quad (2)$$

Where $\alpha=c/(a+b-c)$ and $\beta=(a+b-2c)/(a+b-c)$.

In connection with this, in an image forming apparatus in the form of a laser printer or the like, as mentioned above, image information is digitized or binarized, and so the image ratio can be obtained from bit map data in the control apparatus 44 that controls the exposing apparatus 32. Specifically, the image ratio is calculated for each of the colors at every certain sampling interval (sec) and a control signal with which the optimum secondary transferring current I would be obtained is generated by the control apparatus 44 based on the above equation (2), 50 that the high-voltage secondary transferring power source 43 is controlled by that control signal, thereby applying the optimum transferring current to the secondary transferring roller 36. In the above process, the smaller the sampling interval is, the more finely the transferring current can be controlled, namely, under the more optimum condition the image forming operation can be performed.

As per the above, in this embodiment, upon secondary transfer in an image forming apparatus equipped with an intermediate transferring member (i.e., intermediate transferring belt), an optimum value I of the secondary transferring current is determined using the above equation (2) based on the image ratios of the respective toner images transferred in a overlapping manner. Then, the optimum secondary transferring current I thus determined is applied by the high-voltage secondary transferring power source 43 to the secondary transferring roller 36. Thus, the optimum secondary transferring current I can be applied in accordance with the respective image ratios, and so it is possible to prevent transferring errors from occurring so as to obtain high quality images.

While the invention has been described with reference to the structures disclosed herein, it is not confined to the details set forth and the invention is intended to cover such modifications or changes as may come within the scope of the annexed claims.

What is claimed is:

1. An image forming apparatus comprising:

an image bearing member;

image forming means for forming an image on said image bearing member;

a contact transferring member for transferring the image on said image bearing member onto a transferring medium;

transferring current applying means for applying a current to said contact transferring member; and control means for controlling an amount of the current applied by said transferring current applying means;

wherein images formed on said image bearing member are transferred in a superposed manner onto the transferring medium when the transferring medium is conveyed between said image bearing member and said contact transferring member, and wherein said control means determines an amount of current to be applied to said contact transferring member based on:

an image ratio in a direction perpendicular to a direction in which the transferring medium is conveyed, of an image that has already been transferred onto the transferring medium, an image ratio in a direction perpendicular to a direction in which the transferring medium is conveyed, of an image on said image bearing member, and an image ratio in a direction perpendicular to a direction in which the transferring medium is conveyed, of a portion in which the image that has already been transferred and the image on the image bearing member overlap.

2. An image forming apparatus according to claim 1, further comprising resistance detecting means for detecting a resistance of the transferring medium, wherein said control means determines the amount of the current to be applied to said contact transferring member in accordance with the resistance value information obtained by said resistance detecting means.

3. An image forming apparatus according to claim 1, further comprising temperature and humidity detecting means for detecting temperature and humidity inside the image forming apparatus or in the environment thereof, wherein said control means determines the amount of the current to be applied to said contact transferring member in accordance with temperature and humidity information obtained by said temperature and humidity detecting means.

4. An image forming apparatus according to claim 1, wherein the image ratio in a direction perpendicular to a direction in which the transferring medium is conveyed, of the portion in which the image that has already been transferred and the image on the image bearing member overlap is calculated for each of the numbers of overlapping layers of the images.

5. An image forming apparatus according to claim 1, wherein said control means calculates the image ratios at every specific time period so as to determine the amount of the current to be applied to said contact transferring member.

6. An image forming apparatus according to claim 1, further comprising:

a plurality of image bearing members;

transferring medium conveying means for conveying said transferring medium; and a plurality of contact transferring members each disposed in contact with a surface of said transferring medium conveying means opposite a respective one of said plurality of image bearing members, wherein images on said plurality of image bearing members are sequentially transferred in a superposed manner onto the transferring medium that is being conveyed by said transferring medium conveying means.

7. An image forming apparatus according to claim 1, wherein the transferring medium is an intermediate transferring member, and images that have been transferred in a superposed manner on the intermediate transferring member thereafter are transferred onto a transferring material at one time.

* * * * *

UNITED STATES PATENT AND TRADEMARK OFFICE

CERTIFICATE OF CORRECTION

PATENT NO. : 6,658,220 B2
DATED : December 2, 2003
INVENTOR(S) : Yuji Bessho et al.

It is certified that error appears in the above-identified patent and that said Letters Patent is hereby corrected as shown below:

Title page,
Item [56], References Cited, FOREIGN PATENT DOCUMENTS, "03065975 A" should read -- 03-065975 A --.

Column 2,
Line 43, "otherhand" should read -- other hand --.

Column 3,
Line 8, "images" should read -- image --.

Column 5,
Line 48, "and Pb" should read -- and Pd --.
Line 59, "(i.e. clockwise)" should read -- (i.e., clockwise) --.

Column 6,
Line 65, "and 4b" should read -- and 4d --.

Column 7,
Line 17, "by the rotation" should read -- by rotation --.
Line 44, "(developed)" should read -- (develop) --.

Column 12,
Line 51, "have" should read -- has --.

UNITED STATES PATENT AND TRADEMARK OFFICE

CERTIFICATE OF CORRECTION

PATENT NO. : 6,658,220 B2
DATED : December 2, 2003
INVENTOR(S) : Yuji Bessho et al.

It is certified that error appears in the above-identified patent and that said Letters Patent is hereby corrected as shown below:

Column 17,
Line 4, “50” should read -- so --.

Signed and Sealed this

First Day of June, 2004

JON W. DUDAS
*Acting Director of the United States Patent and Trademark Office*